US009133643B2

(12) United States Patent
Wasterval

(10) Patent No.: US 9,133,643 B2
(45) Date of Patent: Sep. 15, 2015

(54) DRILLING RIG ASSEMBLY METHOD AND APPARATUS

(71) Applicant: International Drilling Equipment Company LLC, Spring, TX (US)

(72) Inventor: Philip Wasterval, Spring, TX (US)

(73) Assignee: International Drilling Equipment Company LLC, Spring, TX (US)

( * ) Notice: Subject to any disclaimer, the term of this patent is extended or adjusted under 35 U.S.C. 154(b) by 0 days.

(21) Appl. No.: 13/938,037

(22) Filed: Jul. 9, 2013

(65) Prior Publication Data

US 2013/0318890 A1 Dec. 5, 2013

Related U.S. Application Data

(63) Continuation of application No. 12/492,980, filed on Jun. 26, 2009, now Pat. No. 8,555,564.

(51) Int. Cl.
*E04H 12/34* (2006.01)
*E21B 15/00* (2006.01)

(52) U.S. Cl.
CPC ..... *E04H 12/344* (2013.01); *E21B 15/00* (2013.01); *Y10T 29/49826* (2015.01)

(58) Field of Classification Search
USPC ..... 52/111, 112, 114, 115, 123.1, 169.13, 52/745.03, 745.17, 745.18, 121; 405/196, 405/202, 221, 220
See application file for complete search history.

(56) References Cited

U.S. PATENT DOCUMENTS 3,327,997 A * 6/1967 Zenke ..... 254/89 R
3,828,513 A * 8/1974 Vanderklaauw ..... 52/745.04
3,942,593 A * 3/1976 Reeve et al. ..... 173/186
4,197,689 A * 4/1980 DeMuth ..... 52/745.01
4,375,241 A * 3/1983 Gallon ..... 173/151
4,757,592 A * 7/1988 Reed ..... 29/429
4,831,795 A * 5/1989 Sorokan ..... 52/120
5,492,436 A * 2/1996 Suksumake ..... 405/201
5,839,239 A * 11/1998 Jang ..... 52/123.1
6,045,297 A * 4/2000 Voorhees et al. ..... 405/303
6,161,358 A * 12/2000 Mochizuki et al. ..... 52/651.05
6,581,525 B2 6/2003 Smith
6,719,062 B2 * 4/2004 Fikes et al. ..... 166/379
7,931,076 B2 * 4/2011 Ditta et al. ..... 166/75.11
2003/0102166 A1 * 6/2003 Jortveit ..... 175/162
2003/0121230 A1 7/2003 Bockhorn et al.
2003/0172599 A1 9/2003 Frink
2004/0211572 A1 * 10/2004 Orr et al. ..... 173/1
2006/0048933 A1 * 3/2006 Van Way ..... 166/77.2
2009/0000218 A1 * 1/2009 Lee et al. ..... 52/123.1
2009/0188677 A1 * 7/2009 Ditta et al. ..... 166/382
2009/0272540 A1 * 11/2009 Rodgers ..... 166/377
2010/0150660 A1 * 6/2010 Nadarajah et al. ..... 405/196
2011/0072737 A1 * 3/2011 Wasterval ..... 52/115
2011/0114386 A1 * 5/2011 Souchek ..... 175/52
2014/0262518 A1 * 9/2014 Reddy et al. ..... 175/57
2014/0262519 A1 * 9/2014 Petrello et al. ..... 175/57

FOREIGN PATENT DOCUMENTS

SU 1709059 A1 * 1/1992

* cited by examiner

*Primary Examiner* — Ryan Kwiecinski
(74) *Attorney, Agent, or Firm* — Osha Liang LLP

(57) ABSTRACT

A drilling rig including a base structure, a lifting device attached to the base structure, and a rig floor comprising a derrick and drilling equipment disposed thereon, in which the lifting device is configured to lift the rig floor so that at least one box may be inserted between the base structure and the rig floor, the rig floor having load points attached thereto and configured to be aligned with the lifting device.

14 Claims, 7 Drawing Sheets

DRILLING RIG ASSEMBLY METHOD AND APPARATUS

CROSS-REFERENCE TO RELATED APPLICATIONS

The present application is a continuation of, and therefore claims priority to, U.S. patent application Ser. No. 12/492,980 filed on Jun. 26, 2009. The priority application is hereby incorporated by reference in its entirety.

BACKGROUND

1. Field of the Disclosure

Embodiments disclosed herein relate generally to drilling rigs. In particular, embodiments disclosed herein relate to drilling rig assembly methods and apparatus.

2. Background Art

A drilling rig is used to drill a wellbore in a formation. Drilling rigs may be large structures that house equipment used to drill water wells, oil wells, or natural gas extraction wells. Drilling rigs sample sub-surface mineral deposits, test rock, soil and groundwater physical properties, and may also be used to install sub-surface fabrications, such as underground utilities, instrumentation, tunnels or wells. Drilling rigs may be mobile equipment mounted on trucks, tracks, or trailers, or more permanent land or marine-based structures (such as oil platforms). The term "rig," therefore, generally refers to a complex of equipment that is used to penetrate the surface of the earth's crust.

Referring to FIG. 1, a conventional drilling rig 30 is shown. Drilling rig 30 includes a derrick 14, which provides a support structure for a majority of the equipment used to raise and lower a drillstring 25 into and out of a wellbore. The drillstring 25 may be an assembled collection of drillpipe, drill collars, or any other assortment of tools, connected together and run into the wellbore to facilitate the drilling of a well (drillpipe 16 is shown in joints prior to being connected together). The drillstring 25 may be raised and lower into and out of the wellbore by the draw-works 7, which includes a spool powered by a motor or other power source 5. A drill line 12, which may be a thick, stranded metal cable, is run from the draw-works 7 over a crown block 13 and down through a travelling block 11. Typically, the crown block 13 remains stationary while the travelling block 11 moves vertically with the drillstring 25. The combination of the crown block 13 and the travelling block 11 provides a significant mechanical advantage for lifting the drillstring 25. Further, a swivel 18 may be attached to the travelling block 11 to allow rotation of the drillstring 25 without twisting the travelling block 11.

The drilling rig 30 further includes a rotary table 20 mounted in a rig floor 21, which is used to rotate the drillstring 25 along with a kelly drive 19. Kelly drive 19, attached at an upper end to the swivel 18 and at a lower end to the drillstring 25, is inserted through the rotary table 20 to rotate the drillstring 25 (drillstring rotation shown by arrow "R"). Kelly drive 19 may be square, hexagonal, or any other polygonal-shaped tubing and is able to move freely vertically while the rotary table 20 rotates it. Alternatively, drilling rig 30 may include a top drive (not shown) in place of kelly drive 19 and rotary table 20. Additionally, blowout preventers ("BOPs") may be located below the rig floor 21 and installed atop a wellhead 27 to prevent fluids and gases from escaping from the wellbore. An annular BOP 23 and one or more ram BOPs 24 are shown and are commonly understood in the art.

During drilling operations, drilling fluid may be circulated through the system to carry cuttings away from the bottom of the wellbore as drilling progresses. Drilling fluid may be stored in mud tanks 1 before being drawn through suction line 3 by mud pumps 4. Drilling fluid (drilling fluid route is indicated by arrows "F") is then pumped from mud pumps 4 through a hose 6, up a stand pipe 8, through a flexible hose 9, and down into the wellbore. Drilling fluid returning from the wellbore is routed through a flow line 28 to shakers 2, which are used to separate drill cuttings from the drilling fluid before it is pumped back down the wellbore.

When designing a drilling rig, numerous factors may be taken into account. For instance, referring still to FIG. 1, the crown block 13 must be located high enough to pull the drillstring 25 from the wellbore for assembly or disassembly. This may require that the derrick structure 14 be built having a substantial height to have the crown block 13 high enough above the wellbore. Additionally, the rig floor 21 must be high enough off the ground to allow the blowout prevention equipment, namely BOPs 23, 24, to fit beneath the rig floor 21 when mounted on the wellhead 27. Due to these design factors, among others, the size of drilling rigs is often very large. Due to the large size, assembly of the drilling rigs may often be difficult.

Different methods have been employed to assemble drilling rigs and attempt to overcome the difficulty associated with assembling very large structures having on them a substantial amount of drilling equipment. One method used is known as "box on box," which basically uses a crane to stack large box structures on top of one another up to a certain height. The crane is then used to lift the rig floor onto the stacked boxes. After the rig floor is installed, the remaining equipment, including the derrick and blocks, must be assembled. One drawback to this assembly method is that a substantial crane is required to lift the equipment during assembly, which due to often rough terrain in remote drilling locations becomes extremely costly or even unfeasible in certain conditions. Also, assembly of a majority of the drilling equipment occurs after the rig floor is installed, and thus, must take place at the rig floor height, which may be 25-40 feet (8-12 m) off the ground.

Other methods used to assemble drilling rigs are known as "swing up," "slingshot," or some other form of parallelogram method. Using any of these methods, the drilling rig is, in a sense, collapsed because the rig floor sits on a base near the ground with the legs laid out horizontal. A hydraulic or wire-line system then pulls the structure up (the rig floor is lifted off the ground and the legs are raised to a vertical position). However, these assembly methods typically incur unusually high loads, which may increase chances of mechanical failure. Additionally, active participation of rig personnel is required during assembly. Accordingly, there exists a need for a method and apparatus for a drilling rig capable of being assembled with minimal extra equipment (e.g., cranes) and minimal rig personnel participation during assembly.

SUMMARY OF THE DISCLOSURE

In one aspect, embodiments disclosed herein relate to a method to assemble a drilling rig, the method including providing a base structure of the drilling rig, stacking a rig floor including a derrick on the base structure, actuating lifting cylinders to lift the rig floor above the base structure, inserting at least one first upper box between the base structure and the rig floor, and retracting the lifting cylinders to set the rig floor atop the at least one first upper box.

In other aspects, embodiments disclosed herein relate to a drilling rig including a base structure, lifting cylinders, and a rig floor including a derrick and drilling equipment disposed thereon, wherein the lifting cylinders are configured to extend and retract to lift the rig floor and insert at least one upper box.

Other aspects and advantages of the invention will be apparent from the following description and the appended claims.

DETAILED DESCRIPTION

Figure 5A:
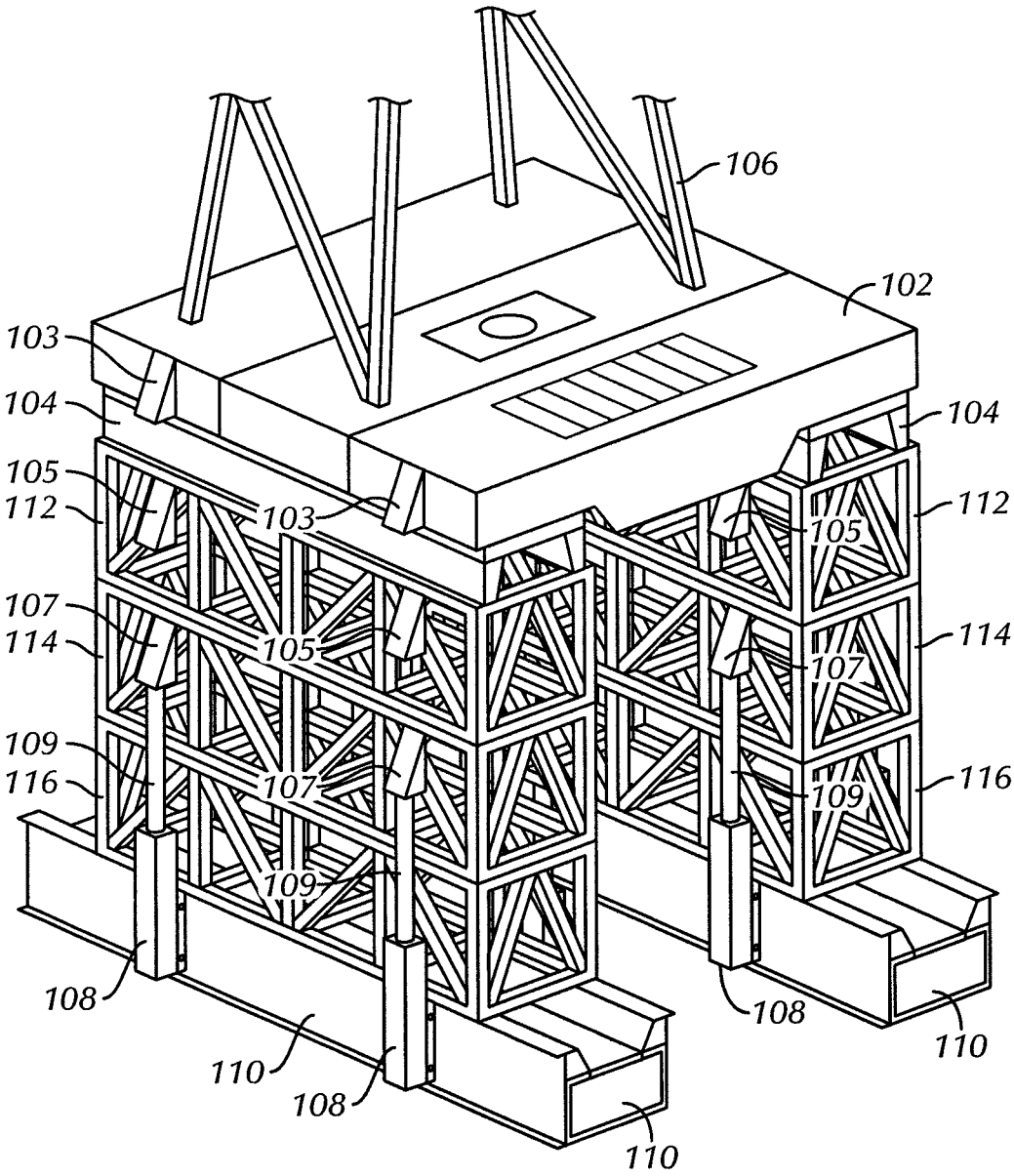
FIG. 5A is a perspective view of multiple upper boxes inserted between the rig floor and base structure in accordance with embodiments of the present disclosure.

In one aspect, embodiments disclosed herein relate to drilling rig assembly methods and apparatus that use multiple box structures stacked on top of one another to elevate the drilling rig to a certain height. Referring initially to FIG. 5A, a perspective view of a bottom portion of a fully assembled drilling rig 100 is shown in accordance with embodiments of the present disclosure. Drilling rig 100 includes a base structure 110, multiple upper boxes 112, 114, and 116 stacked thereon, and a rig floor 102 located atop upper boxes 112, 114, 116. Drilling rig 100 also includes lifting cylinders 108 attached to base structure 110. Drilling rig 100 is assembled according to the following sequence.

Figure 1:
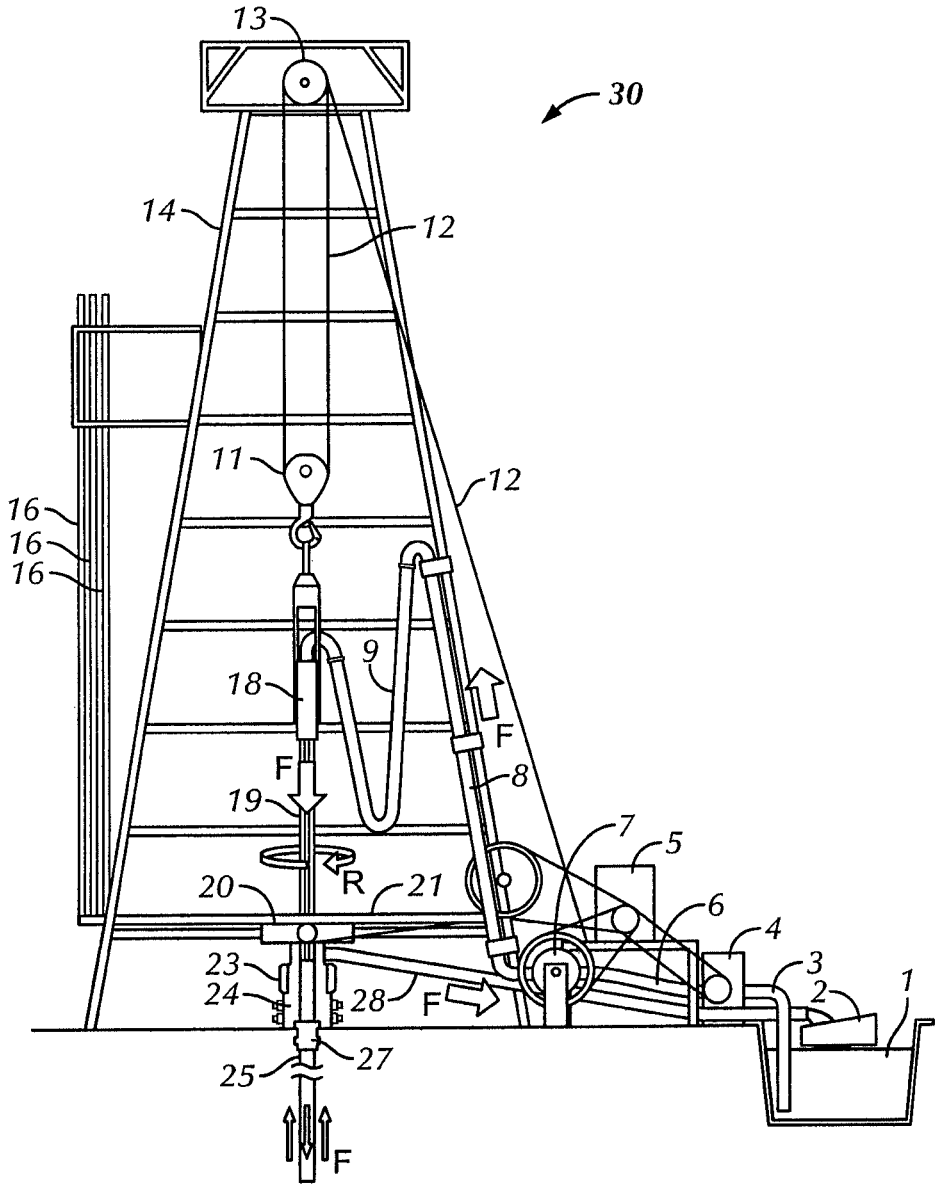
FIG. 1 (Prior Art)
FIG. 1 is a cross-sectional schematic view of a conventional drilling rig.
Figure 2:
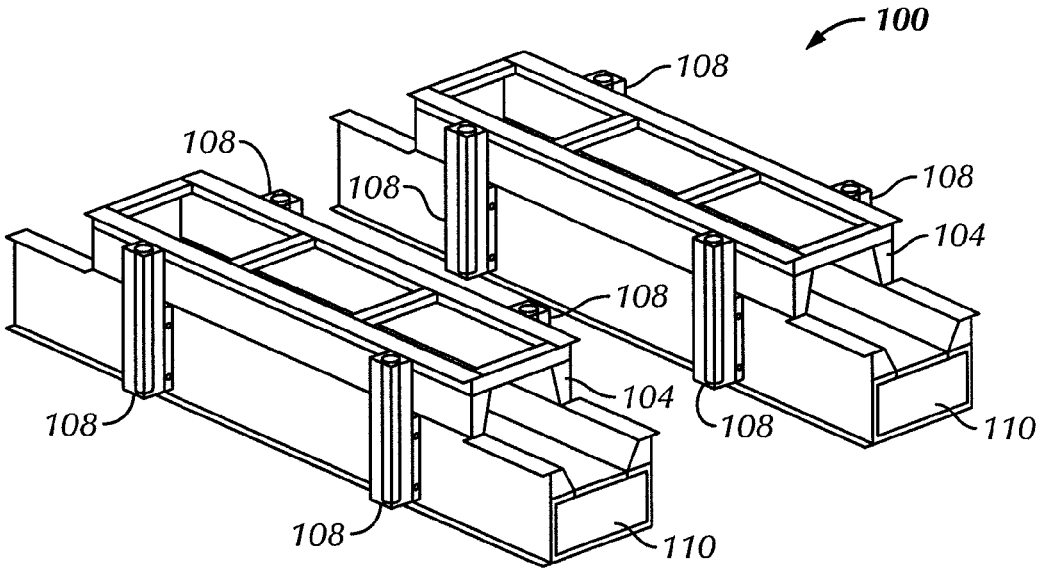
FIG. 2 is a perspective view of a base structure of a drilling rig in accordance with embodiments of the present disclosure.

Referring to FIG. 2, a perspective view of a base structure 110 of a drilling rig 100 is shown in accordance with embodiments of the present disclosure. Base structure 110 may be configured as a land based structure or as an offshore platform. Base structure 110 includes at least two bottom box structures that are positioned at ground level to form a base structure from which to assemble drilling rig 100. The bottom box structures may be configured as parallelogram truss structures or solid beams. Initially, strongback beams 104, which are beams or girders that act as secondary support members, may rest on top of the bottom box structures of base structure 110. The combination of the stacked bottom box structures of base structure 110 and strongback beams 104 may be about 8-10 feet in height. Additionally, base structure 110 may include lifting cylinders, or hydraulic cylinders 108, attached thereto. Hydraulic cylinders 108 may be welded or fastened using mechanical fasteners to base structure 110. Those skilled in the art will understand that other types of lifting cylinders may also be used, including but not limited to, pneumatic cylinders, electric cylinders, and mechanical screws.

Figure 3A:
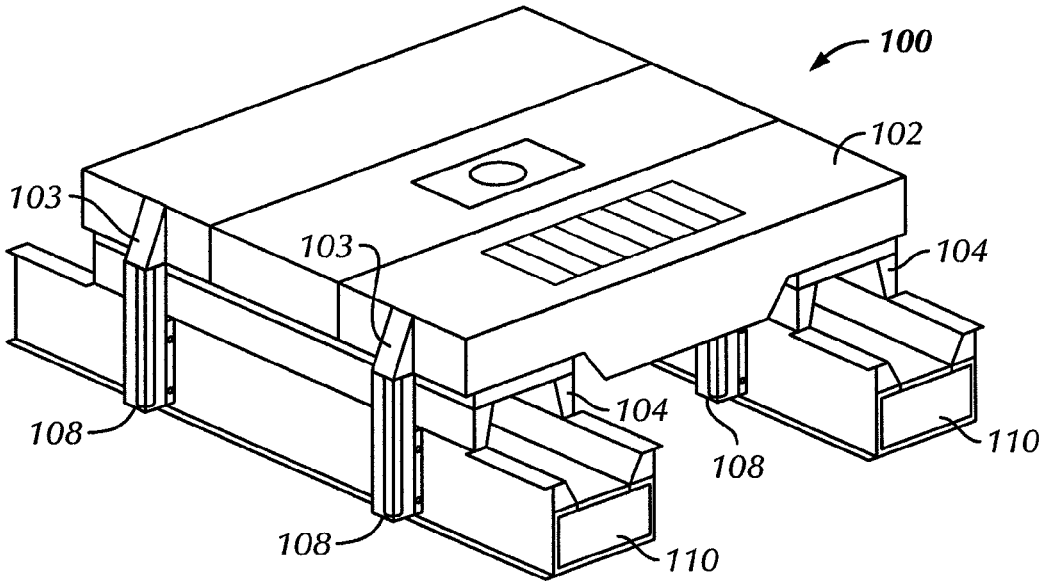
FIG. 3A is a perspective view of a rig floor installed onto the base structure of FIG. 2 in accordance with embodiments of the present disclosure.
Figure 3B:
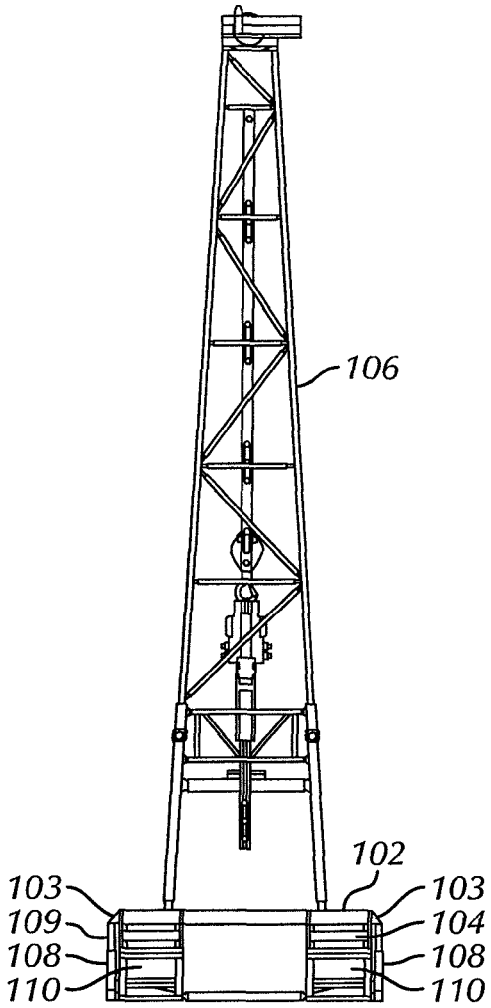
FIG. 3B is a front view of an entire drilling rig installed onto the base structure as in FIG. 3A in accordance with embodiments of the present disclosure.
Figure 3C:
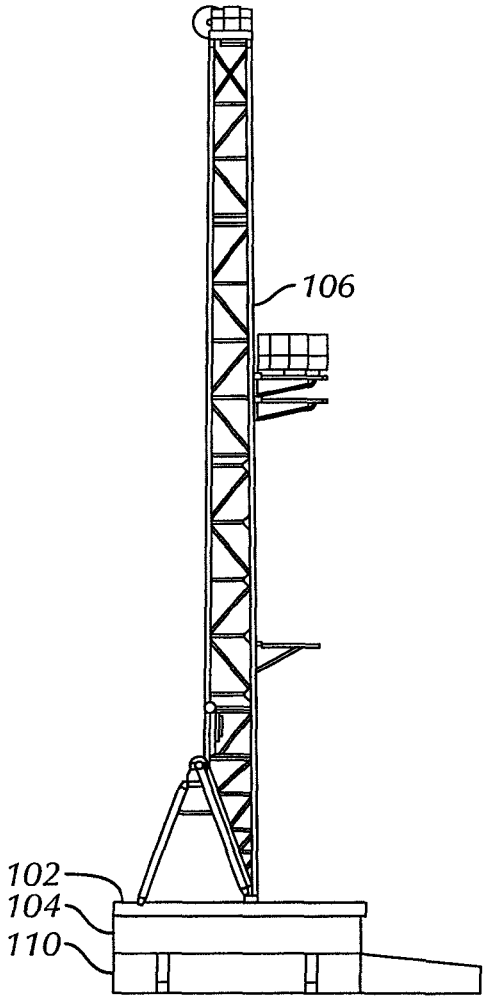
FIG. 3C is a side view of the drilling rig shown in FIG. 3B in accordance with embodiments of the present disclosure.

Now referring to FIG. 3A, a perspective view of a rig floor 102 including one or more pieces installed onto the base structure 110 of the drilling rig 100 is shown in accordance with embodiments of the present disclosure. Rig floor 102 is shown installed onto base structure 110 and strongback beams 104. Strongback beams 104 may be attached to rig floor 102, e.g., welded or fastened with mechanical fasteners. Rig floor 102 may be positioned on base structure 110 squarely so that load points 103 of the rig floor 102 are aligned with cylinders 108 of base structure 110. As shown in FIGS. 3B and 3C, the rig floor 102 may include a derrick 106 (shown in FIGS. 3A and 3B) and all required drilling equipment installed thereon prior to being assembled onto base structure 110 (derrick and drilling equipment installed at ground level rather than at a final rig floor height). Thus, the rig floor 102 may be considered a completed rig floor with all required drilling equipment installed thereon prior to stacking the rig floor on the base structure and no further assembly may be required after the rig floor is elevated to a final height.

Figure 4A:
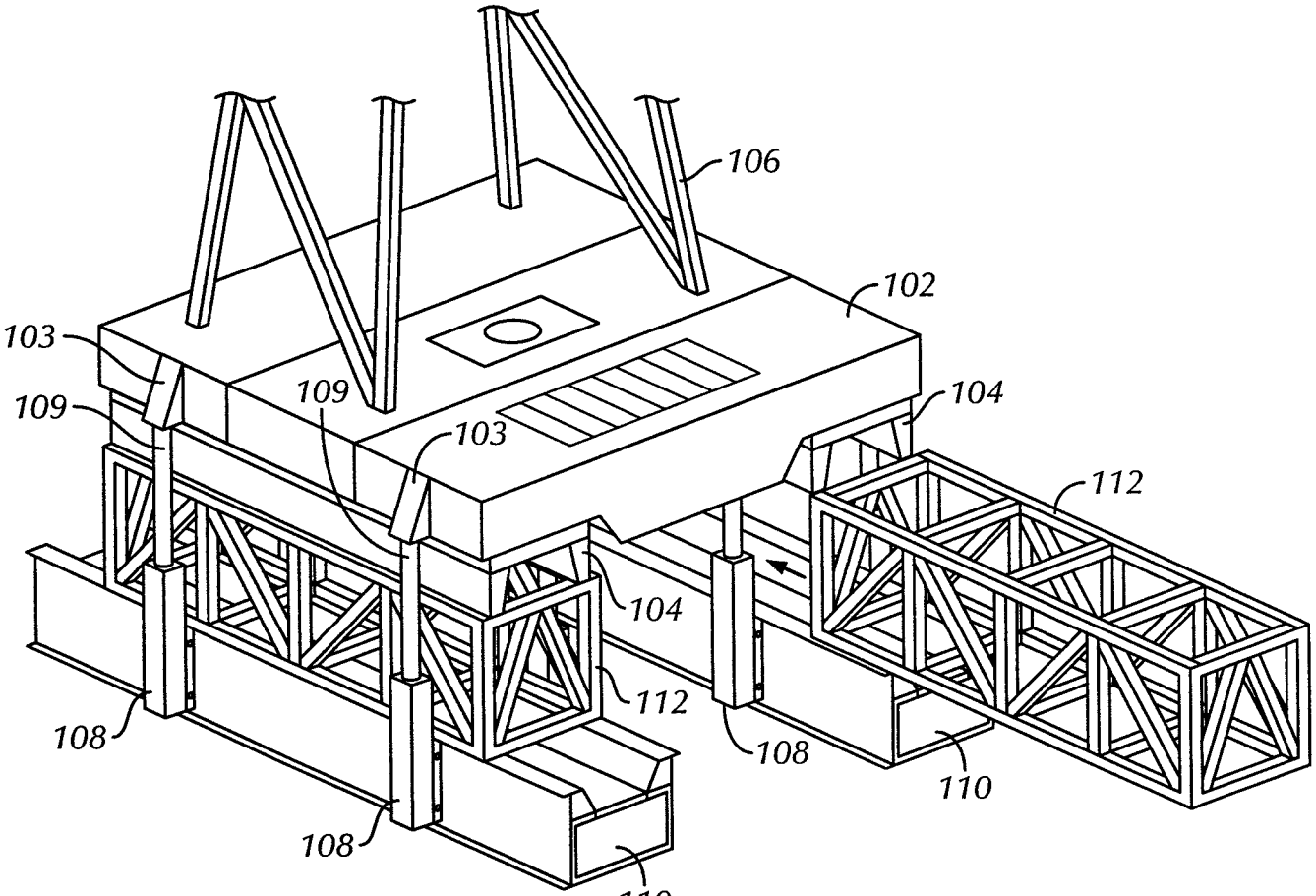
FIG. 4A is a perspective view of a first upper box inserted between the rig floor and base structure in accordance with embodiments of the present disclosure.
Figure 4B:
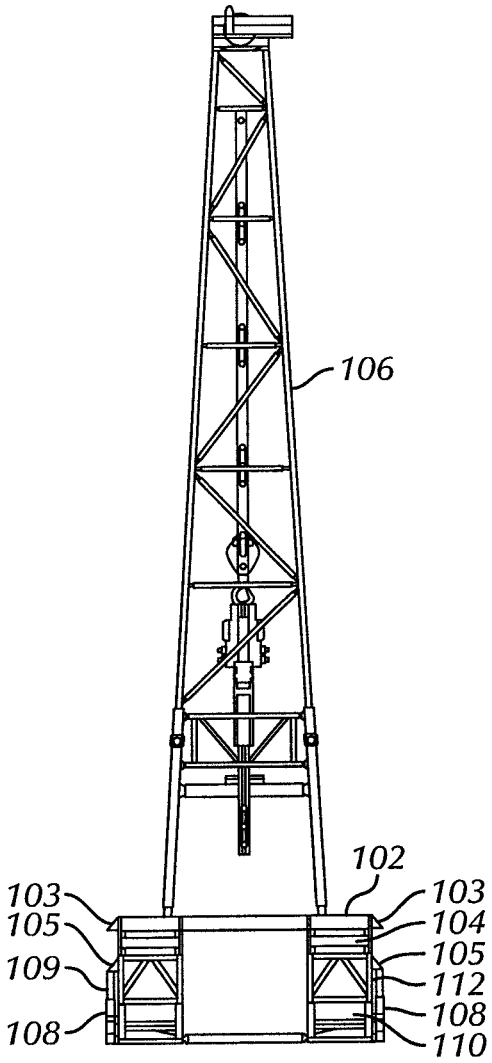
FIG. 4B is a front view of an entire drilling rig with a first upper box inserted between the drilling rig and the base structure in accordance with embodiments of the present disclosure.
Figure 4C:
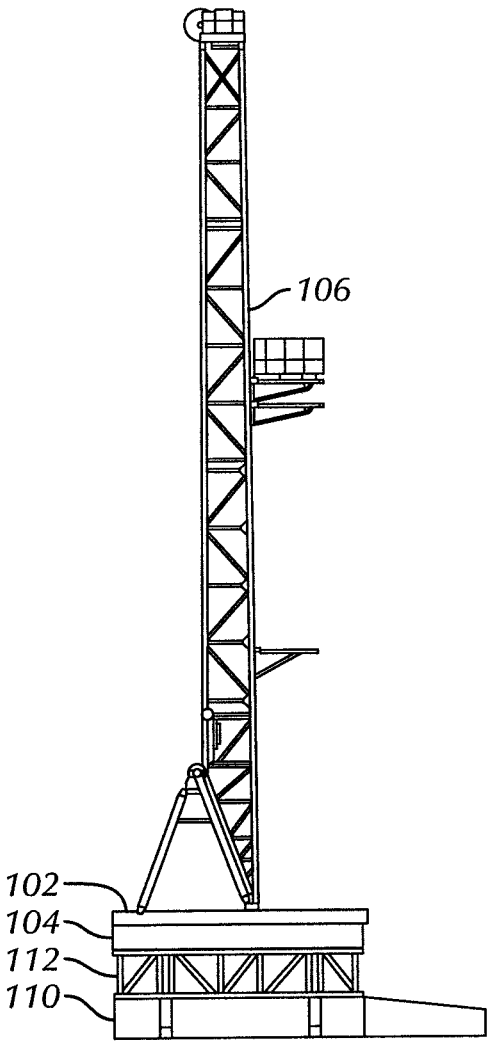
FIG. 4C is a side view of the drilling rig shown in FIG. 4B in accordance with embodiments of the present disclosure.

As shown in FIG. 4A-4C, after the rig floor 102 is installed onto the base structure 110, the cylinders 108 may be actuated and arms 109 of the cylinders 108 extended to contact load points 103 of rig floor 102 and elevate the rig floor 102. After the arms 109 of cylinders 108 are fully extended, a gap may exist between the base structure 110 and the rig floor 102. Full extension of arms 109 may be about 8 feet (about 2.5 m), thus, the gap between the base structure 110 and rig floor 102 is about 8 feet (about 2.5 m). A first upper box 112 may then be inserted into the gap created between the base structure 110 and rig floor 102. First upper boxes 112 may also be approximately 8 feet (about 2.5 m) in height, and thus, when arms 109 of cylinders 108 are retracted, rig floor 102 immediately rests on top of first upper boxes 112.

Figure 5B:
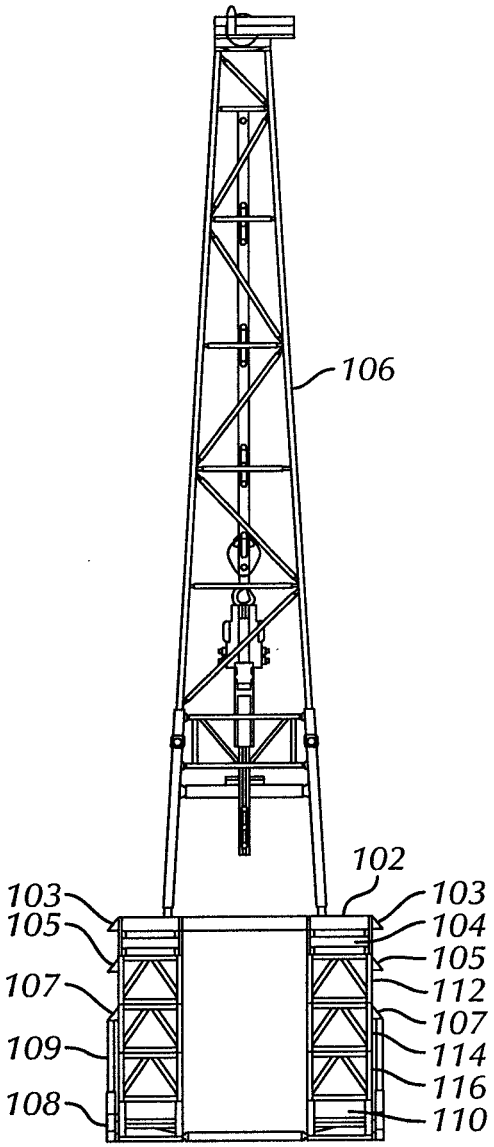
FIG. 5B is a front view of an entire drilling rig with multiple upper boxes inserted between the drilling rig and the base structure in accordance with embodiments of the present disclosure.
Figure 5C:
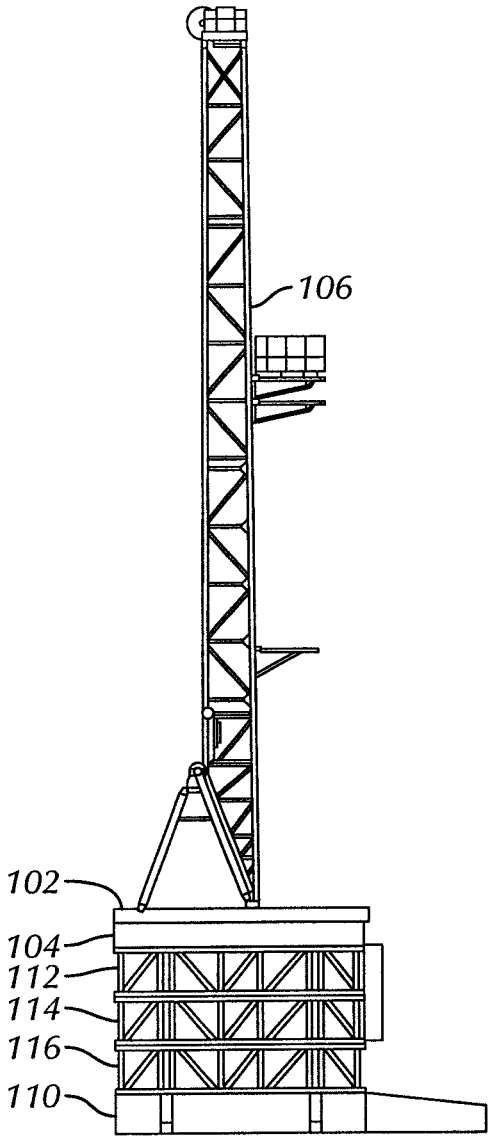
FIG. 5C is a side view of the drilling rig shown in FIG. 5B in accordance with embodiments of the present disclosure.

Referring now to FIGS. 5A-5C, a drilling rig 100 having multiple upper boxes 112, 114, and 116 is shown in accordance with embodiments of the present disclosure. Additional upper boxes may be added in the same manner as the first upper box (previously described) to elevate the rig floor 102 to a desired height. To insert additional upper boxes, arms 109 (shown in FIG. 4A) of the cylinders 108 may be extended to contact load points 105 of first upper box 112. Arms 109 may be completely extended, which as before, leaves a gap between the first upper box 112 and base structure 110 into which a second upper box 114 may be inserted. Subsequently, arms 109 of cylinders 108 may be retracted. Load points 105 and 107 may be hinged or slid so that they may collapse into the upper box on which they are mounted (upper box 112 and 114, respectively) and no longer protrude outside the upper box. The load points may collapse or otherwise moved out of position so that they do not interfere with extension of arms 109 of cylinders 108. In alternative embodiments, an additional upper box may be inserted between an elevated rig floor and the first upper box, which is stacked atop the base structure.

To insert a third upper box, load points 107 of second upper box 114 may be hinged open to align with cylinders 108. Arms 109 are completely extended, which elevates second upper box 114 and leaves a gap between the second upper box 114 and the base structure 110 into which a third upper box 116 may be inserted. Subsequently, arms 109 of cylinders 108 may be retracted. In alternative embodiments, an additional upper box may be inserted between an elevated rig floor and the second upper box, which is stacked atop the first upper box.

As previously mentioned, the desired height of the drilling rig 100 may be determined by the room needed below the rig floor 102 to install blowout preventer equipment. Also, the crown block at the top of the derrick must be far enough above the ground to be able to pull the drillpipe. Those skilled in the art will understand the height requirements to meet these criteria. In certain embodiments disclosed herein, a drilling rig having a rig floor stacked on three upper boxes and a base structure (bottom boxes) may have its rig floor at a height of about 38-40 feet (8-12 m).

Advantageously, embodiments of the present disclosure provide a method of assembling a drilling rig, which requires substantially less intervention from rig personnel as well as heavy lifting equipment, including larger cranes. The assembly method allows a drilling rig to be assembled in more remote locations where heavy equipment would be unable to travel. Remote drill sites may be more accessible using a drilling rig assembled using methods in accordance with embodiments disclosed herein. Therefore, rig assembly costs may be reduced and productivity costs may be increased.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A drilling rig comprising:

a base structure;

a lifting device attached to the base structure;

a rig floor comprising a derrick and drilling equipment disposed thereon; and a first box disposed between the base structure and the rig floor to support the rig floor, wherein the rig floor comprises a load point, the load point of the rig floor being axially aligned with the lifting device, and wherein the first box comprises a box load point, the box load point of the first box being moveable between a protruding position, in which the box load point extends from the first box and is axially aligned with the lifting device to enable the lifting device to lift the first box, and a collapsed position, in which the box load point is retracted into a body of the first box and is not axially aligned with the lifting device to enable the lifting device to lift the rig floor or another box.

2. The drilling rig of claim 1, wherein the lifting device is configured to lift the rig floor and the first box via the box load point such that a second box is capable of being disposed between the base structure and the rig floor.

3. The drilling rig of claim 1, wherein the lifting device comprises hydraulic cylinders.

4. The drilling rig of claim 1, wherein the lifting device comprises pneumatic cylinders.

5. The drilling rig of claim 1, wherein the lifting device comprises mechanical screws.

6. The drilling rig of claim 1, further comprising strongback beams disposed between the rig floor and the first box.

7. The drilling rig of claim 1, wherein the base structure comprises at least two bottom box structures located at ground level.

8. The drilling rig of claim 1, wherein the base structure is configured as a land based structure.

9. The drilling rig of claim 1, wherein the base structure is configured as an offshore platform.

10. The drilling rig of claim 1, wherein the first box comprises a plurality of box load points.

11. The drilling rig of claim 10, wherein, the lifting device is axially aligned with at least one of the plurality of box load points.

12. The drilling rig of claim 10, further comprising a plurality of lifting devices, each axially aligned with at least one of the plurality of box load points.

13. An oilfield rig, comprising:

a base structure and a rig floor having a derrick and an oilfield equipment disposed thereon; and a lifting device configured to lift the rig floor to separate the rig floor and the base structure forming a space; at least one box disposed within said space, wherein the rig floor comprises a load point, the load point of the rig floor being axially aligned the lifting device, and wherein the at least one box comprises a box load point, the box load point of the at least one box being moveable between a protruding position, which the box load point extends from the at least one box and is axially aligned with the lifting device to enable the lifting device to lift the at least one box, and a collapsed position, in which the box load point is retracted into a body of the at least one box and is not axially aligned with the lifting device to enable the lifting device to lift the rig floor or another box.

14. The oilfield rig of claim 13, wherein the at least one box supports the rig floor at a given height.

* * * * *